US006296498B1

(12) United States Patent
Ross

(10) Patent No.: US 6,296,498 B1
(45) Date of Patent: Oct. 2, 2001

(54) BUSBAR CONNECTOR FOR PLUG-IN BUSWAYS

(75) Inventor: Steven L. Ross, Pittsburgh, PA (US)

(73) Assignee: Universal Electric Corporation, Bridgeville, PA (US)

( * ) Notice: Subject to any disclaimer, the term of this patent is extended or adjusted under 35 U.S.C. 154(b) by 0 days.

(21) Appl. No.: 09/490,939

(22) Filed: Jan. 25, 2000

(51) Int. Cl.[7] ..... H01R 4/60
(52) U.S. Cl. ..... 439/115; 439/213
(58) Field of Search ..... 439/110–115, 213, 439/210, 723, 724; 174/80 B

(56) References Cited

U.S. PATENT DOCUMENTS

| | | | | |
|---|---|---|---|---|
| 3,601,748 | * | 8/1971 | Hart | 439/115 |
| 3,605,064 | * | 9/1971 | Routh | 439/115 |
| 3,831,130 | * | 8/1974 | Valtonen | 439/115 |
| 3,871,730 | * | 3/1975 | Hesse | 439/115 |
| 4,053,194 | * | 10/1977 | Gilman | 439/115 |
| 6,039,584 | | 3/2000 | Ross . | |
| 6,093,037 | * | 7/2000 | Lin | 439/115 |

OTHER PUBLICATIONS

Star Line Track Busway, Universal Electric Corporation Catalog (undated).
Star Line Busway System, Universal Electric Corporation Catalog (undated).
Track Sections (undated).
GE Busway, Type LTG Busway Plug–in Dimensions (1997 Issue).
Power–Trac, Trac Systems Halo–2, Halo/Power–Trac Lighting (undated).

* cited by examiner

*Primary Examiner*—Renee Luebke
*Assistant Examiner*—Briggitte R Hammond
(74) *Attorney, Agent, or Firm*—David W. Brownlee; Eckert Seamans Cherin & Mellott, LLC

(57) ABSTRACT

A busbar connector for an electrical busway system is disclosed which includes shunt wires in an insulating housing and opposed spreader springs between the shunt wires that press contacts on the shunt wires against busbars in the busway when tapered screws are advanced between the spreader springs.

20 Claims, 6 Drawing Sheets

BUSBAR CONNECTOR FOR PLUG-IN BUSWAYS

BACKGROUND OF THE INVENTION

1. Field of the Invention

This invention relates to an electrical plug-in busways in which multiple electrically-isolated, conductive busbars are housed in elongated track sections for feeding electricity to take-off devices that may be inserted into the track, and, in particular, to busbar connectors between adjacent track sections.

2. Description of the Prior Art

It is common in factories, shops, offices and other buildings to provide overhead electrical power distribution tracks for providing a convenient source of electricity for lights, machines and other electrical devices in the buildings. Take-off devices are used to tap power from the track to the load apparatus. The load may be anything from a lamp to a three phase electrical machine. It is desirable to be able to insert take-off devices into or remove them from the track at any point along the track itself and make a secure electrical contact with the busbars.

Electrical power distribution tracks are typically comprised of an elongated housing containing multiple electrically-isolated, conductive busbars. Track lighting and continuous plug-in busway are typical of this type of track system. Track sections can be from 2 to 20 feet long. Sections of the track can be joined together by connectors to form long runs for power distribution.

The connectors between track sections must electrically connect the busbars in one track section to the busbars in the adjoining track section or sections. Connectors are also used to feed electrical power to the distribution tracks. Power feed connectors typically plug into the ends of the track sections. Typically, the busbar connector assembly contains conductive bars that make pressure contact with the busbars to provide the electrical connection between track sections.

A variety of busbar connectors are known in the art. One system of busbar connectors uses thin pieces of spring temper metal that is capable of carrying no more than 20 amperes of current. The spring metal is shaped so that the spring temper of the material exerts pressure contact points on the busbars.

Another system uses connector pins and sleeves. Conductive pins are installed between exposed busbars in adjoining track sections. The pins include either a spring pressure means or a screw pressure means. The ends of the busbars are exposed on all sides to receive the connectors or have hollow interiors for installation of the pins.

A third system uses solid metal connector bars and springs or screws for pressing the connector bars against the busbars in adjoining track sections.

An improved busbar connector is needed that substantially increases the contact pressure against the busbars in order to provide a more reliable contact that is capable of carrying higher currents than the prior art connectors. Improved busbar connectors are desired which lower construction costs, eliminate or substantially reduce the possibility of breaking the connector bars, provide insulated pressure screws, and do not require gaps between track sections.

SUMMARY OF THE INVENTION

The present invention satisfies all the above needs for an improved busbar connector for plug-in busways. This invention provides a busbar connector that is capable of higher current carrying capacity, is lower in cost, less prone to breaking of the connector bars, has insulated pressure screws and has no gaps between adjoining track sections.

This invention uses shunt wires made of strips of copper, spreader springs, and tapered set screws to press copper contacts on the shunt wires against busbars in the adjoining track sections. The shunt wires are preferably flexible to facilitate assembly of the connector, particularly when the connector is an elbow, tee, or crossover. The set screws are accessible from the edge of the connectors at the mouth of the track section so there is no need for a gap between the adjoining track sections. The shunt wires, springs and tapered set screws are contained in an insulating housing, and copper contacts on the shunt wires project from the housing for engagement against busbars in the busway. For installation of the connector in a busway, the tapered set screws are in the retracted position with the contact assemblies fitting loosely in the connector body so there is room for the copper contacts to move during the installation. Once installed, the screws are turned progressively toward the engaged position in which the taper on the end of the screws forces the spreader springs, shunt wires and copper contacts on the wires outwardly from the connector body. As the screws are turned, the contact pressure against the busbars increases. The spreader springs are made of material such that they flex only a minimal amount and directly transfer the screw pressure to the contact. The flexible shunt wire allows the contact to seat itself firmly and flatly against the busbar and not require precise alignment between adjoining busway sections. Each screw is tightened until adequate pressure is attained. This process is repeated at each contact assembly pair, typically four places in each busbar connector.

DESCRIPTION OF THE PREFERRED EMBODIMENT

Figure 1:
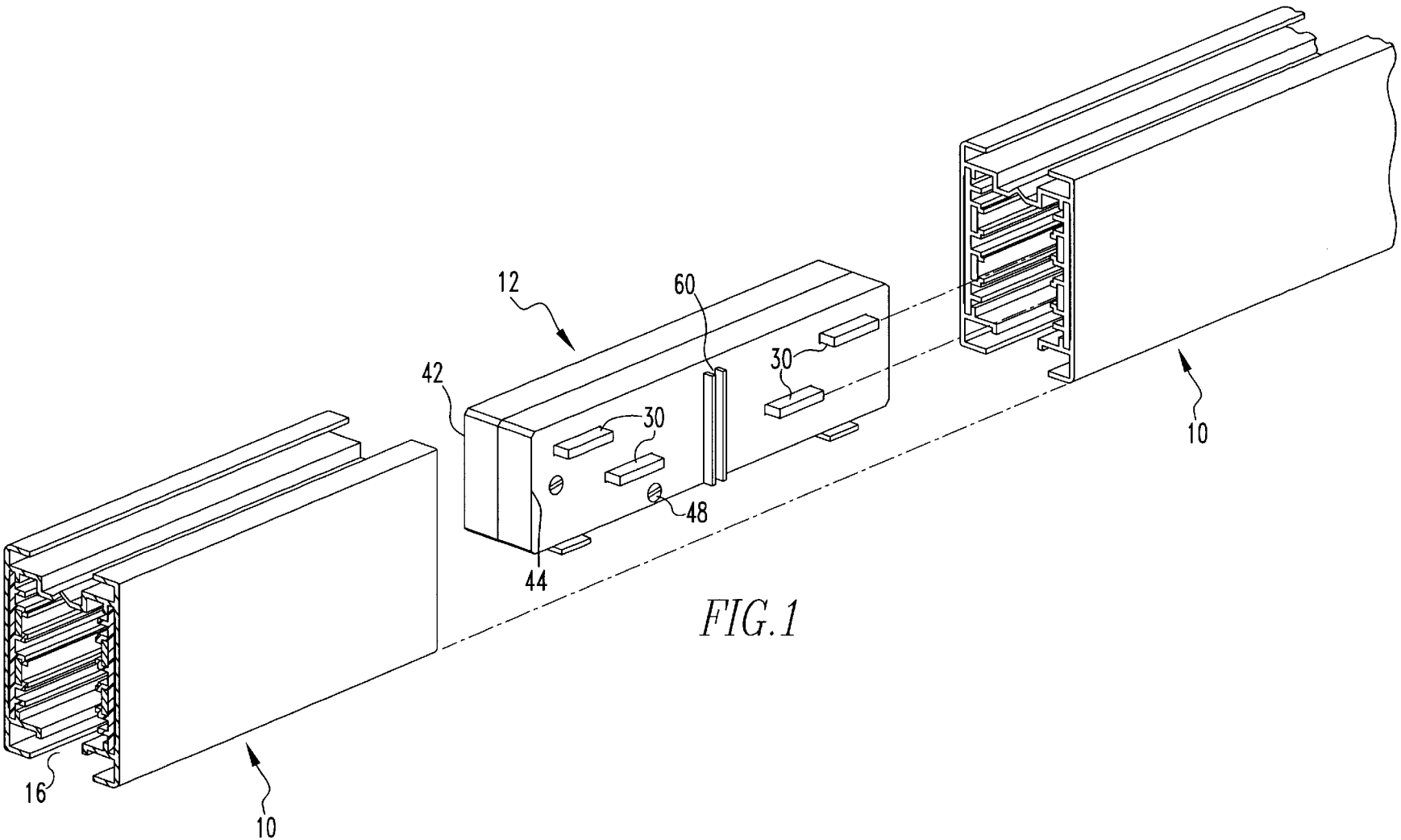
FIG. 1 is an exploded perspective view of two sections of a busway track and a busbar connector of this invention in position between the track section in preparation for joining the two track sections in accordance with this invention.

FIG. 1 shows a preferred embodiment of this invention as including multiple track sections 10 which are joined by a busbar connector(s) 12. The track sections 10 may be up to 20 feet long and two or more sections may be joined to provide a busway system. The track sections 10 may be connected in a straight line or may be interconnected at a cross, tee or elbow, depending on the particular installation.

Figure 2:
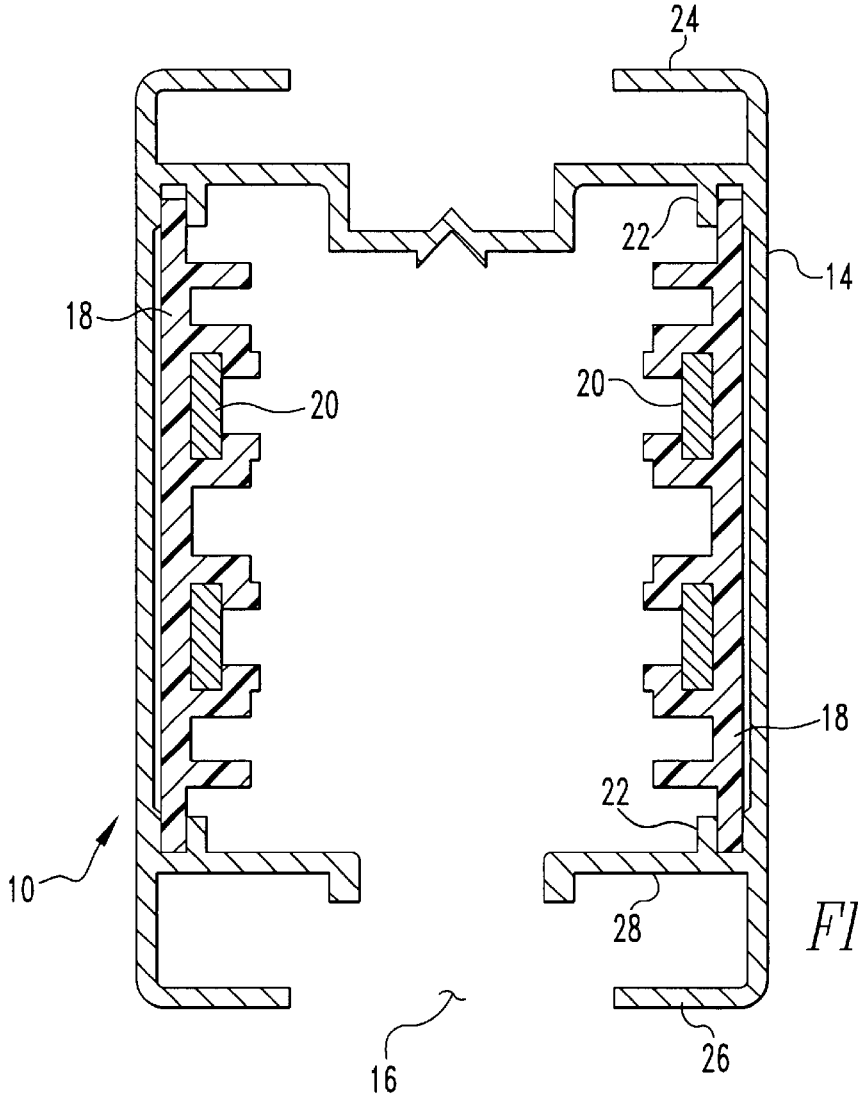
FIG. 2 is a cross-section through a preferred embodiment of a busway track of FIG. 1.

Each track section 10 preferably comprises a channel-shaped aluminum extrusion 14 having a downwardly open access slot 16 and two insulative supports 18 secured in the extrusion (FIG. 2). The supports 18 may have two or more busbars 20 secured in them in slots on opposite sides of the track. The supports 18 are typically made of insulative material such as plastic and are retained in the track 10 by flanges 22 on the extrusion engaged over the longitudinal edges of the supports. The extrusion 14 preferably has top flanges 24, which are suitable for hanging the track from a ceiling or the like, and lower flanges 26, 28 which are suitable for securing the connector 12 in the track. The particular shape of the aluminum extrusion 14 and supports 18 is not important to this invention provided that the track assembly has opposed busbars 20 secured in slots in opposite sides of the track for contact by copper contacts 30 projecting from opposite sides of the connector 12 as is described below.

Figure 3:
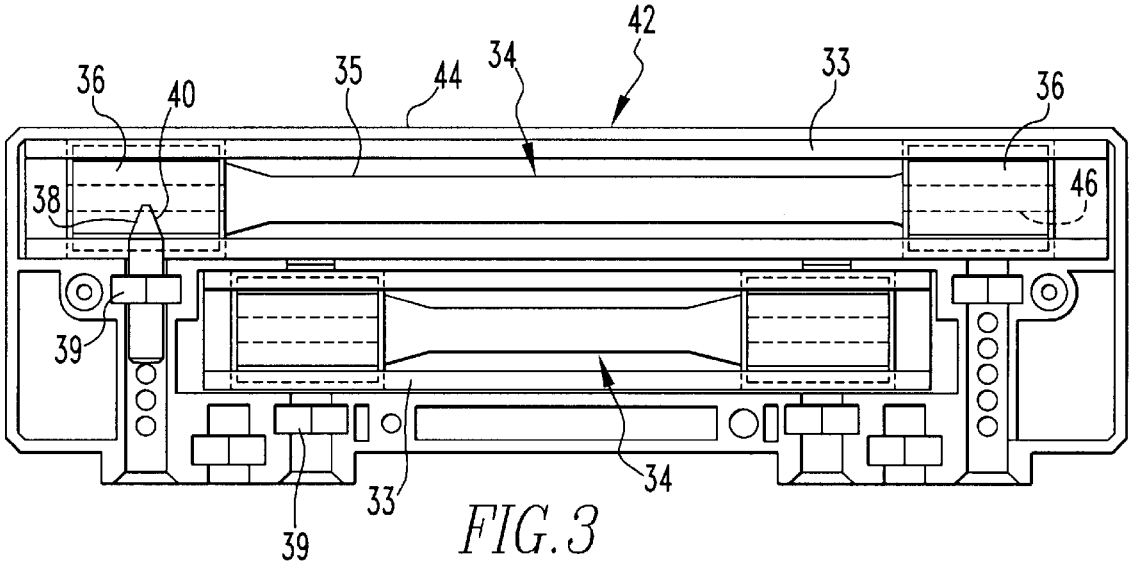
FIG. 3 is a side elevation of half the connector of FIG. 1.
Figure 4:
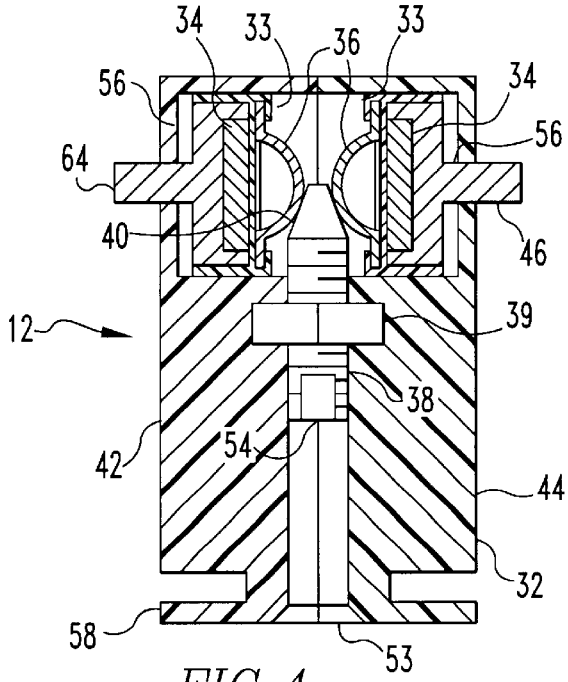
FIG. 4 is a transverse vertical section through the connector of FIG. 1 taken through one set of contacts in the connector.

A preferred embodiment of a busbar connector 12 is best seen in FIGS. 3 and 4 as including an insulative connector body 32, at least two insulative covers/spreader extrusions 33 in the connector body, lug wire assemblies 34, spreader springs 36 in the spreader extrusions, a set screw 38 having a tapered end 40 between the spreader springs, and a captive nut 39. The connector body 32 is preferably made in two halves 42, 44 (FIG. 4) with a vertical line of separation so the spreader extrusions 33, lug wire assemblies 34 and springs 36 can be readily assembled with the body. The spreader extrusions 33 fit in parallel slots 56 in each half of the connector body 32, and the captive nuts 39 and set screws 38 are disposed in mating cavities in the connector halves 42, 44. Screws 48 (FIG. 1) or other fasteners or connector elements can be used to hold the two halves together.

The lug wire assemblies 34 each include a flexible shunt wire 35 and copper contacts 46 (FIG. 5) on each end of the wire. The lug wire assemblies 34 are disposed in the connector body 32 on opposite sides of the body, generally parallel to each other and parallel to the longitudinal axis of the track 10. The copper contacts 46 project from opposite sides of the connector body 32. The shunt wires may be flat and of uniform width as shown in FIG. 5, or may be round along a major portion of their length as shown in FIGS. 4, 7 and 8.

Figure 6:
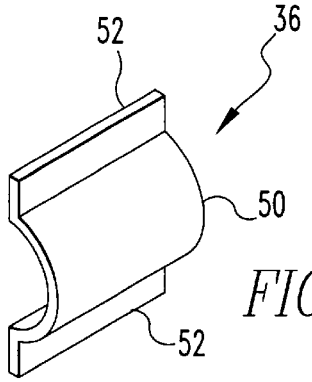
FIG. 6 is a perspective view of a spreader spring used in the connector of FIGS. 1, 3 and 4.

The spreader springs 36 have a generally half cylinder portion 50 between the flat edge portions 52 (FIG. 6). The springs 36 are preferably made of tempered steel which flexes very little. Each nut 39 is held captive in a recess in the connector body 32, with the set screw 38 threaded through the nut so the tapered end 40 of the screw will advance and retract from between the spreader springs 36. The head of the screw 38 is in recessed hole 53 and has a socket 54 (FIG. 4) in it for receiving an allen wrench or a screw driver to rotate the screws. The connector body 32 also preferably has two pairs of outwardly extending flanges 58 on its bottom for sliding engagement between the flanges 26, 28 on the bottom of the track section 10. The connector body 32 may also have a pair of vertically extending ribs 60, the purpose of which is described below in regard to connectors in the form of power feed assemblies.

Figure 5:
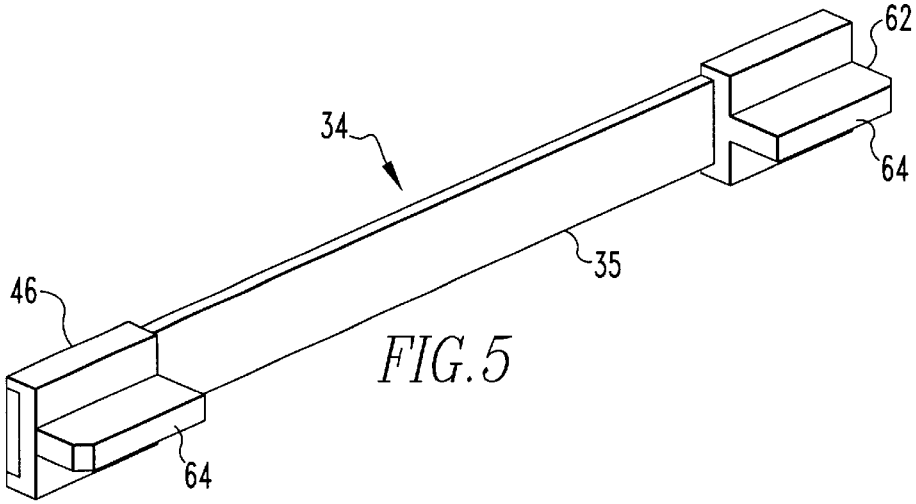
FIG. 5 is a perspective view of a lug wire assembly for the connector of FIGS. 1, 3 and 4.

As best seen in FIG. 5, the copper contacts 46 on the shunt wires 35 are generally T-shaped and are preferably soldered, welded or swaged on the shunt wires 35 so as to have an intimate electrical bond with the wire. The shunt wires 35 are preferably made from a flexible strip of copper that may be about ¼ to ½ inch wide and about 1/16 to ⅛ inch thick. The projecting ribs 62 on the contacts 46 preferably have a flat contact surface 64 of sufficient area to provide a good face-to-face electrical connection with the surface of the busbar 20 in a track section 10.

Figure 7:
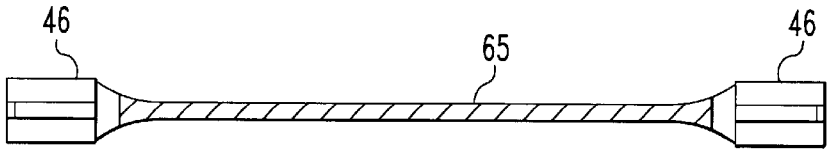
FIGS. 7 and 8 are plan views of alternative embodiments of lug wire assemblies for use in this invention.
Figure 8:
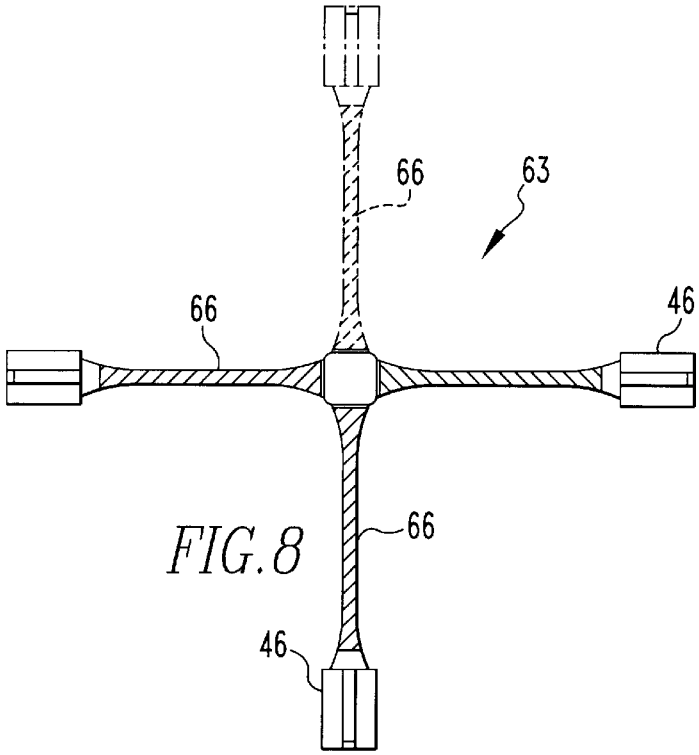
Figure 9:
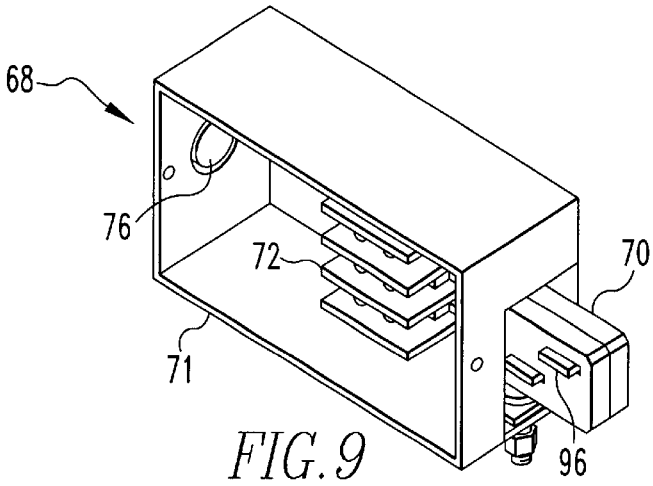
FIG. 9 is a perspective view of a power feed connector assembly of this invention.
Figure 10:
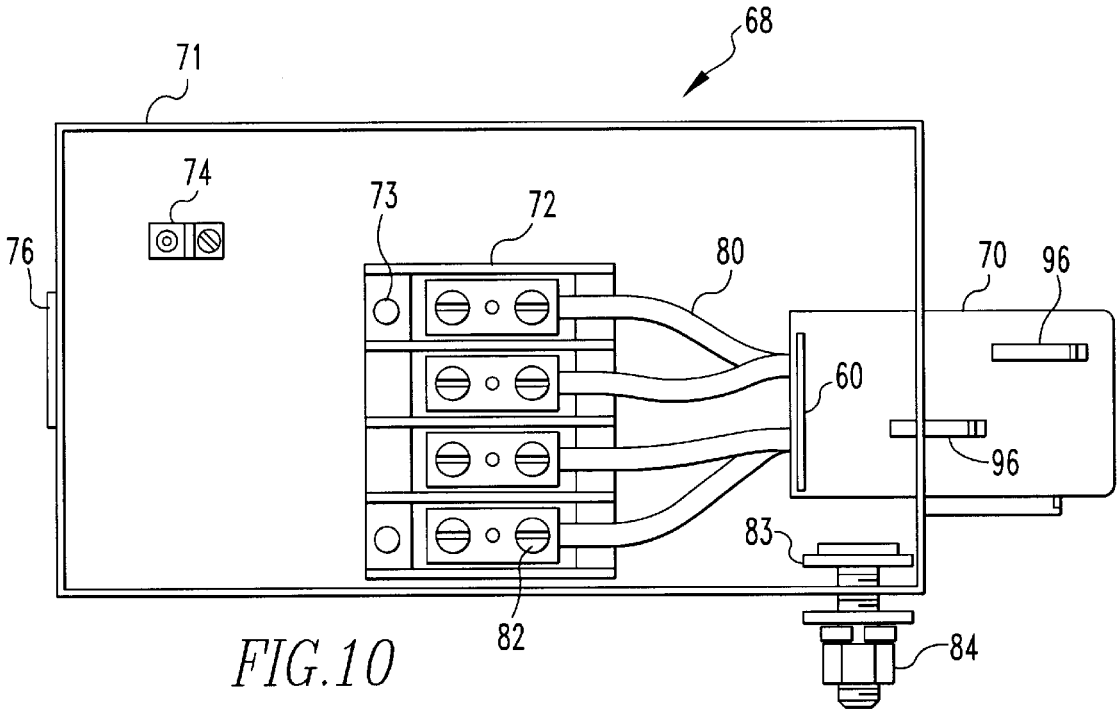
FIG. 10 is a side elevational view of the power feed assembly of FIG. 9.
Figure 11:
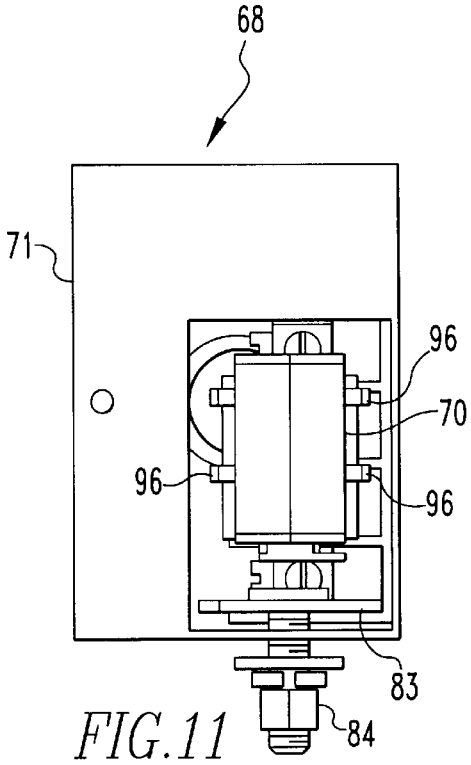
FIG. 11 is an end elevational view of the power feed assembly of FIGS. 9 and 10.

As shown in FIGS. 7 and 8, shunt wires 65, 66 can also be round wires, as for example, about ¼ inch in diameter. The shunt wires 63 in FIG. 8 are shown as either a tee (3 wires) or a cross (4 wires) for use in alternative embodiments of the connector of this invention.

The joining of two track sections 10 by means of a connector 12 will now be described. In preparation for such joining, the set screws 38 are loosened to their retracted positions out of contact with the spreader springs 36 so the copper contacts fit loosely in the connector body 32. The connector 12 can then be slid into position in the end of one track section 10, followed by sliding a second track section 10 onto the connector into abutting position with the end of the first track section. The connector 12 should extend approximately equal distance into each track section. The set screws 38 are then turned progressively towards the upper or engaged position. As each screw 32 moves upwardly, the tapered end forces the spreader springs in opposite directions toward the shunt wires 35. This drives the shunt wires 35 and copper contacts 46 against the busbars 20 in the track section 10. The shunt wires 35 are preferably flexible so the copper contacts 46 will seat squarely against the busbars 20 without need to precisely align the adjoining track sections.

As assembled, there is copper-to-copper contact between busbars in adjoining track sections 10 by shunt wires 35 that are sized to carry the required current. The spreader extrusions 33 in the connector 12 are made of plastic or other insulative material to provide electrical isolation between opposite facing electrical contacts, and also electrically insulate the spreader springs 36 and set screws 38 from the electrical contacts. The spreader springs 36 maintain uniform pressure between the contact surfaces over the life of the assembly.

Modified connectors of this invention can be used to connect track sections 10 which meet at a tee, cross, crossover, or elbow, as well as in a straight line as shown in FIG. 1. The connector body can be molded in the shape of the tee, cross, elbow or the like, and the flexible shunt wires adapted to such shapes. For a tee or cross, the shunt would also have a tee or cross design, as illustrated in FIG. 8, to feed to the multiple track sections.

FIGS. 9–12 show an alternative embodiment of a connector of this invention in the form of a power feed assembly 68 for feeding power to a busway system. The power feed assembly 68 includes a connector head assembly 70 that fits into the end of a track section 10 (FIGS. 1 and 4) just like the connector 12, and has a terminal box 71 and a terminal block 72 in the box for connection to an electrical supply cable, not shown. Connectors such as rivets 73 attach the terminal block 72 to the box 71. The box 71 preferably includes a ground connection 74 and has a hole 76 through the box for a power feed cable, not shown. A cover, also not shown, will be secured over the open side of the terminal box 71.

The head assembly 70 includes a connector body 78, which is the same as the connector body 12 of FIGS. 1, 3 and 4 except that the body 78 is cut vertically between the ribs 60 (FIGS. 1 and 10), which provide a guide for such cut.

Shunt wires 80 from the feed head assembly 70 extend from the end of the connector body 78 and are connected to the terminal block 72 by screws 82. Copper contacts 96 project from sides of the head assembly 70 to contact busbars in a track section in the same manner as the contacts 30 on the connector 12 of FIGS. 3 and 4. The connector body 78 is preferably mounted in the box 71 by a hanger assembly 83 that may be attached to the bottom of the connector body 74 and to the bottom wall of the terminal box 71 with nut 84.

Figure 12:
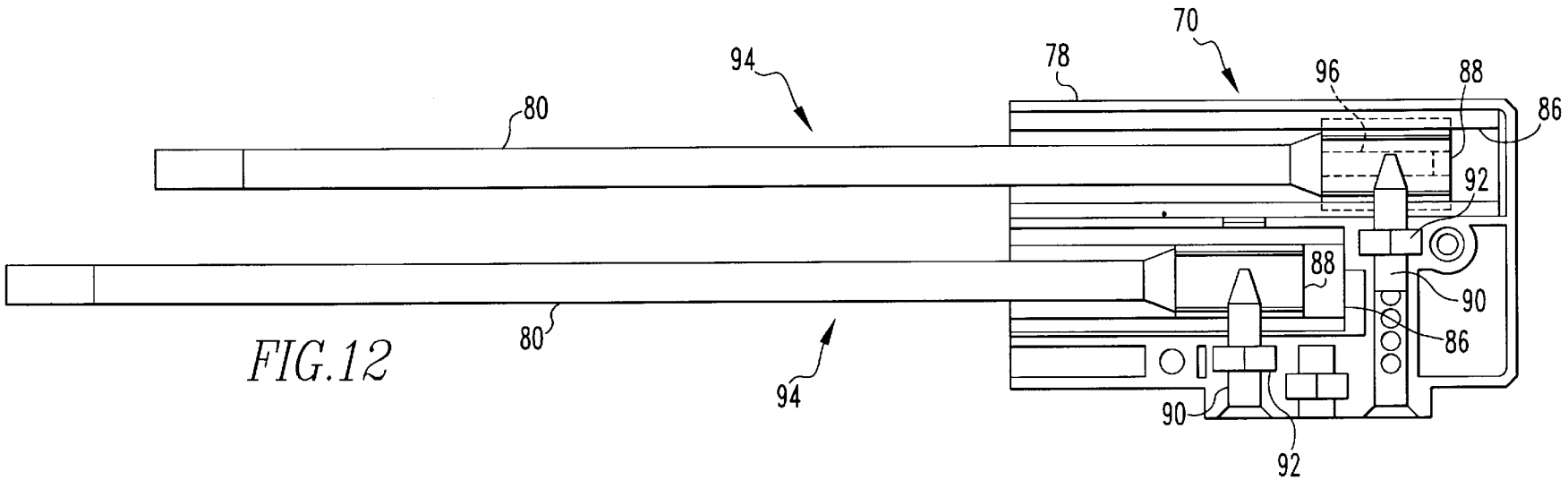
FIG. 12 is a side elevational view of one side (one-half) of the connector head assembly of FIGS. 9–11.

As shown in FIG. 12, the power feed assembly 70 includes spreader extrusions 86, spreader springs 88, screws 90, nuts 92 and lug wire assemblies 94 which are essentially the same as the connector 12 of FIGS. 1, 3 and 4 except that each lug wire assembly has a copper contact lug 96 on only one end of the shunt wire 80, instead of both ends. The other end of the shunt wire 80 is preferably forked for connection to the terminal block 72. The power feed assembly is attached onto the end of a track section in the same manner described above with respect to connector 12. A power supply cable is then connected to the terminal block in a conventional manner.

It is therefore seen that this invention provides high contact pressure for connection busbars in electrical busway, and makes reliable contact, which is capable of carrying high currents of 100 amps or more. This invention is economical to manufacture and reduces construction costs. It also reduces the likelihood of breaking metal connector bars between track sections. The pressure screws in the connector are accessed from the busway slot and do not require a gap between busway sections.

The embodiment disclosed herein is illustrative. It is understood that numerous changes can be made to the preferred embodiment without departing from the invention or the scope of the claims appended hereto.

What is claimed:

1. In an electrical plug-in busway including at least two elongated track sections connected end-to-end and at least one electrically conducting busbar in each track section for providing electricity to a take-off device installed in the track, the improvement comprising:

a connector between the ends of adjoining track sections, said connector including an insulating connector body and at least one shunt wire in the insulating connector body with a lug on both ends of the shunt wire, a spreader spring in said connector body adjacent each said lug, and a set screw for wedging each said spreader spring toward the associated lug and thereby pressing the the lugs into spring pressure contact with said busbars in said connected track sections.

2. A busway as set forth in claim 1 in which each track section has four busbars in it with two on each side of the channel in the track section, and each connector has four flexible shunt wires in it with electrical contacts on opposite ends of each shunt wire, a spreader spring opposite each electrical contact and a tapered set screw between each adjacent pair of spreader springs.

3. A busway as set forth in claim 1 in which said track sections are channel-shaped, each track section includes busbars on opposite sides of said channel, and said connector has shunt wires on opposite sides of the connector for connecting the busbars on opposite sides of the channel and at least one spreader spring between said lugs on the shunt wires for pressing the lugs against the busbars.

4. A busway as set forth in claim 3 in which said connection includes an insulating connector body having at least two spreader springs in the connector body, shunt wires in the spreader member, and electrical contacts on each shunt wire projecting from said connector body for contacting and electrically connecting the busbars in said adjacent track sections, spreader springs for each pair of shunt wires on the opposite side thereof from each electrical contact and a screw having a tapered end for wedging between adjacent spreader springs to press the springs against the shunt wires and said electrical contacts against busbars in the track sections.

5. A busway as set forth in claim 4 in which said insulating body has a hole in it for each set screw which is open at the exposed side of the body in the track section for access to the set screws to tighten them after the connector has been positioned between the ends of adjacent track sections.

6. A busway as set forth in claim 1 in which each said shunt wire is a flat strip of copper.

7. A busway as set forth in claim 6 in which each strip of copper is about ¼ to ½ inch wide and about 1/16 to ⅛ inch thick.

8. In an electrical plug-in busway including at least two elongated track sections connected end-to-end and at least one electrically conducting busbar in each track section for providing electricity to a take-off device installed in the track, the improvement comprising:

a connector between the ends of the adjoining track sections, said connector including an insulating connector body and at least one shunt wire in the insulating connector body with a lug on both ends of said shunt wire in spring pressure contact with said busbars in said connected track sections, and in which said spring pressure is provided by a spreader spring having a generally half-cylinder spring section between flat edge portions.

9. A busway as set forth in claim 8 in which each said spreader spring is made of spring steel.

10. A busbar connector for an electrical busway having at least one channel-shaped track section having at least one open end and busbars in opposite sides of the channel-shaped track section for providing electricity to plug-in devices inserted into the track sections, said connector comprising an insulating connector body for insertion into said at least one open end of said track section, at least two insulative spreader extrusions in the connector body, a shunt wire in each said spreader extrusion, each said shunt wire having an electrical contact lug on at least one end thereof projecting from said connector body for contacting one of said busbars in said track section, spreader springs between the shunt wires and a tapered screw for pressing said spreader springs against said shunt wires and said electrical contact on the shunt wires against the busbars in the track sections.

11. A busbar connector as set forth in claim 10 which includes at least four of said spreader members.

12. A busbar connector as set forth in claim 10 that includes an electrical contact lug on both ends of each said shunt wire.

13. A busbar connector as set forth in claim 10 which is secured to a terminal box and each of said shunt wires has one end thereof electrically connected to a terminal block in said terminal box for feeding power to an electrical busway.

14. A busbar connector as set forth in claim 13 that includes four said shunt wires.

15. A busbar connector connecting channel-shaped track sections in an electrical busway, said track sections each having busbars in opposite sides thereof, said connector comprising an insulating connector boy, four parallel insulative spreader members in said connector body, a flexible shunt wire in each spreader member, each shunt wire having an electrical contact lug on both ends thereof projecting outwardly from the connector body, spreader springs in said spreader members on both ends thereof inside said connector body opposite said contact lugs on each shunt wire, and set screws having tapered ends between said spreader springs for pressing said contact lugs against said busbars in said track sections.

16. A connector as set forth in claim 15 in which said connector body comprises two halves, each of which has channels in it for receiving said spreader members, shunt wires and spreader springs.

17. A connector as set forth in claim 15 in which each said spreader member comprises an elongated plastic extrusion.

18. A connector power head assembly for an electrical busway that includes at least one channel-shaped track section having at least one open end with parallel busbars in the channel for receiving plug-in devices, said connector head assembly comprising an insulating connector body for insertion into said at least one open end of said track section, at least two insulative spreader members in said connector body, a shunt wire in each said spreader member, a spreader spring in each said spreader member, a contact lug on one end of each shunt wire projecting outwardly from said connector body opposite said spreader spring and a set screw having a tapered end between said spreader springs for pressing said springs and said contact lugs against said busbars in said track section.

19. A connector power head assembly as set forth in claim 18 which is assembled with a terminal box having a terminal block secured therein and one end of each said shunt wire is electrically connected to said terminal block.

20. A busbar power head assembly as set forth in claim 19 in which said connector body has a portion thereof that projects from said terminal box for insertion into said track section, with said contact lugs projecting from said portion of the connector body for insertion into the track section.

* * * * *